US008298026B2

(12) United States Patent
Ochiai

(10) Patent No.: US 8,298,026 B2
(45) Date of Patent: Oct. 30, 2012

(54) OUTBOARD MOTOR

(75) Inventor: Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 240 days.

(21) Appl. No.: 12/723,773

(22) Filed: Mar. 15, 2010

(65) Prior Publication Data

US 2010/0240269 A1 Sep. 23, 2010

(30) Foreign Application Priority Data

Mar. 19, 2009 (JP) ..... 2009-067646
Mar. 4, 2010 (JP) ..... 2010-047962

(51) Int. Cl.
*F01N 3/10* (2006.01)
*F01N 3/20* (2006.01)
*F01N 3/04* (2006.01)

(52) U.S. Cl. ..... 440/89 H; 440/89 C

(58) Field of Classification Search ..... 440/89 B, 440/89 H, 89 C, 89 F, 88 R
See application file for complete search history.

(56) References Cited

U.S. PATENT DOCUMENTS 5,306,185 A * 4/1994 Lassanske et al. ..... 440/89 R
6,511,355 B1 * 1/2003 Woodward ..... 440/89 H
6,662,555 B1 * 12/2003 Ishii ..... 60/302
7,704,111 B2 * 4/2010 Ito et al. ..... 440/89 R
2008/0166935 A1 7/2008 Ito et al.

* cited by examiner

*Primary Examiner* — Lars A Olson
*Assistant Examiner* — Andrew Polay
(74) *Attorney, Agent, or Firm* — Keating & Bennett, LLP

(57) ABSTRACT

An outboard motor includes an engine, an exhaust guide, and a catalyst. The engine includes a cylinder and crankshaft. The crankshaft is disposed along a vertical direction. The exhaust guide is arranged to support the engine from below. The catalyst is disposed in an interior of the engine. The engine includes a cylinder body. The cylinder body includes a housing portion arranged to house the catalyst. The cylinder body includes a first exhaust passage that includes an interior of the housing portion. The catalyst is inserted into the housing portion from below and is sandwiched from above and below by the housing portion and the exhaust guide.

11 Claims, 15 Drawing Sheets

OUTBOARD MOTOR

BACKGROUND OF THE INVENTION

1. Field of the Invention

The present invention relates to an outboard motor.

2. Description of the Related Art

An outboard motor according to a prior art is described in US 2008/166935 A1. The outboard motor includes an engine, an engine holder, an exhaust manifold, and a catalyst. The engine is supported from below by the engine holder. The engine includes a cylinder head. The exhaust manifold is disposed at a side of the cylinder head. The exhaust manifold extends vertically at the side of the cylinder head. An upper end portion of the exhaust manifold is coupled to the cylinder head by bolts. Also, a lower end portion of the exhaust manifold is coupled to the engine holder by bolts. The catalyst is disposed inside the manifold.

SUMMARY OF THE INVENTION

The inventor of preferred embodiments of the present invention described and claimed in the present application conducted an extensive study and research regarding an outboard motor, such as the one described above, and in doing so, discovered and first recognized new unique challenges and previously unrecognized possibilities for improvements as described in greater detail below.

That is, with the outboard motor according to the prior art described above, the catalyst is disposed inside the exhaust manifold. Installation of the catalyst is thus complicated.

In order to overcome the previously unrecognized and unsolved challenges described above, a preferred embodiment of the present invention provides an outboard motor including an engine, an exhaust guide, and a catalyst. The engine includes a cylinder and a crankshaft. The crankshaft is disposed along a vertical direction. The exhaust guide is arranged to support the engine from below. The catalyst is disposed in an interior of the engine. The engine includes a cylinder body. The cylinder body includes a housing portion arranged to house the catalyst. The cylinder body defines a first exhaust passage that includes an interior of the housing portion. The catalyst is inserted into the housing portion from below and is sandwiched from above and below by the housing portion and the exhaust guide.

By this arrangement, the catalyst is inserted from below into the housing portion provided in the cylinder body. Installation of the catalyst is thus simple in comparison to a case where the catalyst is disposed inside the exhaust manifold. Also, the catalyst is held in a state of being sandwiched from above and below by the housing portion and the exhaust guide. An exhaust manifold arranged to hold the catalyst is thus unnecessary. An increase in the number of parts of the outboard motor is thereby prevented.

The catalyst may be disposed at a side of the cylinder. The cylinder body may include a first cooling water passage and a second cooling water passage. The first cooling water passage may be disposed in a periphery of the cylinder. The second cooling water passage may be disposed in a periphery of the catalyst. The second cooling water passage may be connected to the first cooling water passage at a location between the cylinder and the catalyst.

The outboard motor may further include an intermediate member disposed at least at one of a location between the catalyst and the housing portion and a location between the catalyst and the exhaust guide. The catalyst may be sandwiched from above and below by the housing portion and the exhaust guide via the intermediate member. The intermediate member may include an elastic member.

The engine may include a cylinder head coupled to the cylinder body. The cylinder head may define a second exhaust passage arranged to connect the cylinder and the first exhaust passage. The cylinder body may include a first mating surface, and a first end surface disposed on the same plane as the first mating surface. The cylinder head may include a second mating surface overlapped with the first mating surface, and a second end surface disposed on the same plane as the second mating surface. The first exhaust passage may include an exhaust entrance arranged to open at the first end surface. The second exhaust passage may include an exhaust exit arranged to open at the second end surface. The exhaust exit may be connected to the exhaust entrance.

Also, the cylinder body may include a supported surface provided at a lower end portion of the cylinder body. The housing portion may include a lower surface disposed on a same surface as the supported surface.

Also, an outer shape of the catalyst as viewed from a direction in which the exhaust passes through the catalyst may be circular.

Also, the engine may include a cylinder head coupled to the cylinder body. The cylinder head may define a second exhaust passage arranged to connect the cylinder and the first exhaust passage. The catalyst may be disposed such that an upper end of the catalyst is positioned above a lower end of the cylinder. The outboard motor may include a drain passage connected to at least one of the first exhaust passage and the second exhaust passage at an upstream side of the catalyst.

Also, the drain passage may include a first end portion connected to at least one of the first exhaust passage and the second exhaust passage at the upstream side of the catalyst, and a second end portion connected to the first exhaust passage at a downstream side of the catalyst.

Also, the second exhaust passage may include an exhaust exit connected to the first exhaust passage. The exhaust exit may be disposed above a lowermost end of the second exhaust passage at a downstream side relative to the lowermost end of the second exhaust passage. The drain passage may be connected to the lowermost end of the second exhaust passage and be arranged such that water is discharged from the lowermost end of the second exhaust passage to the drain passage.

Also, the outboard motor may include a valve connected to the drain passage. The valve may be arranged to control a flow of a fluid in the drain passage.

Also, the valve may include a float arranged to open and close the valve according to a water amount in the valve.

Other elements, features, steps, characteristics and advantages of the present invention will become more apparent from the following detailed description of the preferred embodiments with reference to the attached drawings.

DETAILED DESCRIPTION OF PREFERRED EMBODIMENTS

First Preferred Embodiment

An outboard motor according to a first preferred embodiment of the present invention shall now be explained in detail with reference to FIG. 1A, FIG. 1B and FIG. 2 to FIG. 10. In the figures, an arrow F indicates a front side of the outboard motor. In the description that follows, "front side," "rear side," "right side," and "left side" refer to the front side, rear side, right side, and left side, respectively, of the outboard motor.

Figure 1A:
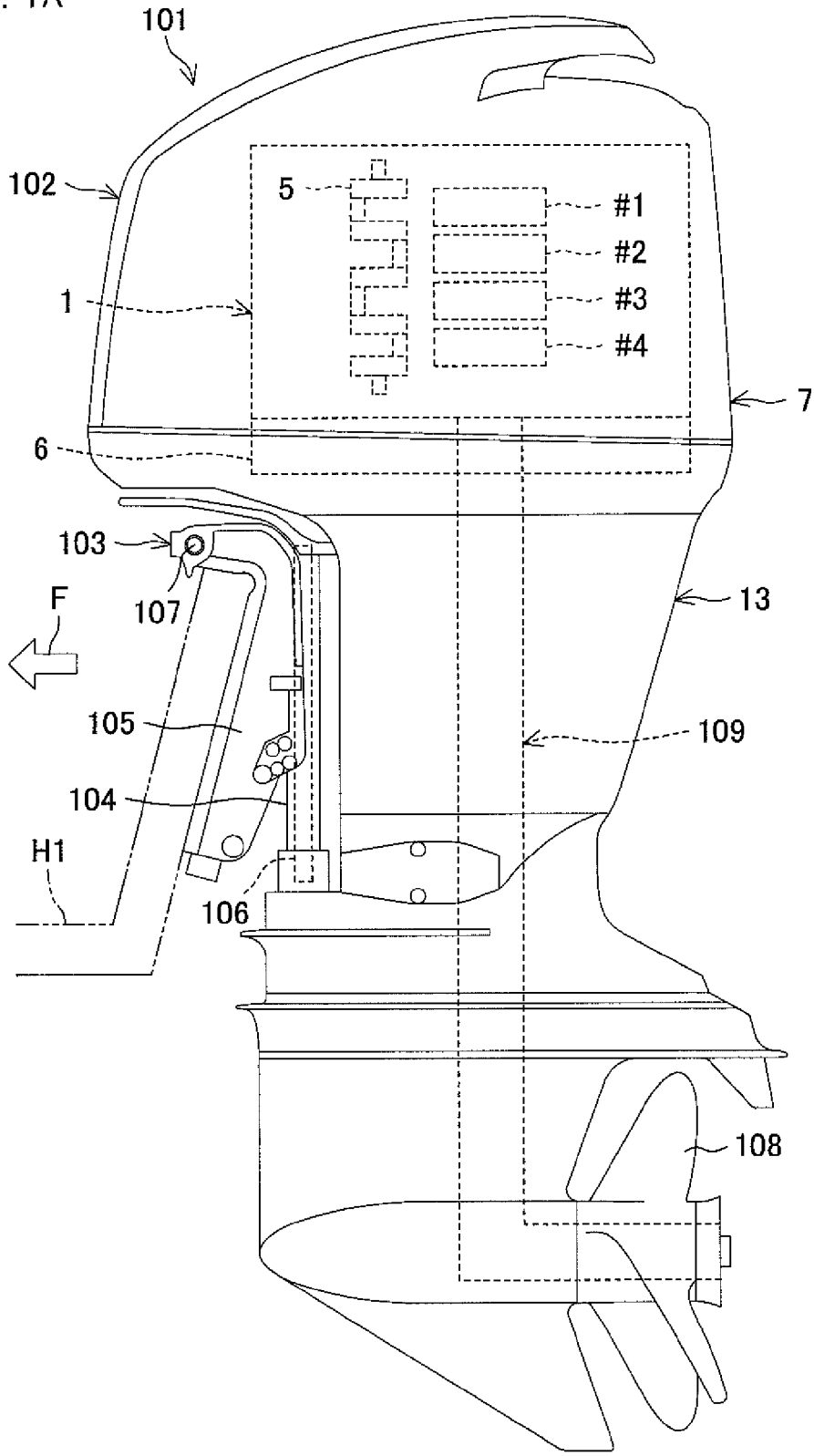
FIG. 1A is a side view of an outboard motor according to a first preferred embodiment of the present invention.

As shown in FIG. 1A, the outboard motor 101 includes an outboard motor main body 102 and an attachment mechanism 103. The outboard motor main body 102 is attached to a rear portion of a hull H1 by the attachment mechanism 103. The attachment mechanism 103 includes a swivel bracket 104, a clamp bracket 105, a swivel shaft 106, and a tilt shaft 107. The swivel shaft 106 is disposed so as to extend vertically. The tilt shaft 107 is disposed horizontally so as to extend to the right and left. The swivel bracket 104 is coupled to the outboard motor main body 102 via the swivel shaft 106. Also, the clamp bracket 105 is coupled to the swivel bracket 104 via the tilt shaft 107. The clamp bracket 105 is fixed to the rear portion of the hull H1.

The outboard motor main body 102 is pivotable to the right and left about the swivel shaft 106 with respect to the swivel bracket 104 and the clamp bracket 105. The hull H1 is steered by the outboard motor main body 102 being pivoted about the swivel shaft 106. Also, the outboard motor main body 102 and the swivel bracket 104 are pivotable vertically about the tilt shaft 107 with respect to the clamp bracket 105. The outboard motor main body 102 is pivoted about the tilt shaft 107 in a state where a front surface of the outboard motor main body 102 is directed downward. The outboard motor main body 102 is thereby tilted up.

As shown in FIG. 1A, the outboard motor main body 102 includes an engine 1, an exhaust guide 6, an engine cover 7, and an upper casing 13. The engine 1 is an internal combustion engine that generates power by combustion of gasoline or other fuel. The engine 1 is disposed inside the engine cover 7. The engine 1 is disposed such that a crankshaft 5 extends vertically. The engine 1 includes, for example, four cylinders (a first cylinder #1, a second cylinder #2, a third cylinder #3, and a fourth cylinder #4). The four cylinders are aligned vertically. The engine 1 is supported from below by the exhaust guide 6. The engine 1 is coupled to the exhaust guide 6 by a plurality of fixing bolts 6*a* (see FIG. 3). Also, an upper portion of the upper casing 13 is coupled to a lower portion of the exhaust guide 6.

Also, as shown in FIG. 1A, the outboard motor main body 102 includes a propeller 108 and a main exhaust passage 109. The propeller 108 is driven to rotate by the engine 1. A propulsive force that drives the hull H1 forward or in reverse is generated by the rotation of the propeller 108. Also, the main exhaust passage 109 is disposed in an interior of the outboard motor main body 102. A first end portion of the main exhaust passage 109 is connected to the engine 1. A second end portion of the main exhaust passage 109 is connected to the propeller 108. An exit of the main exhaust passage 109 opens underwater. For example, in a state where the engine 1 is rotating at high speed, exhaust generated at the engine 1 is discharged underwater through the main exhaust passage 109.

Figure 5:
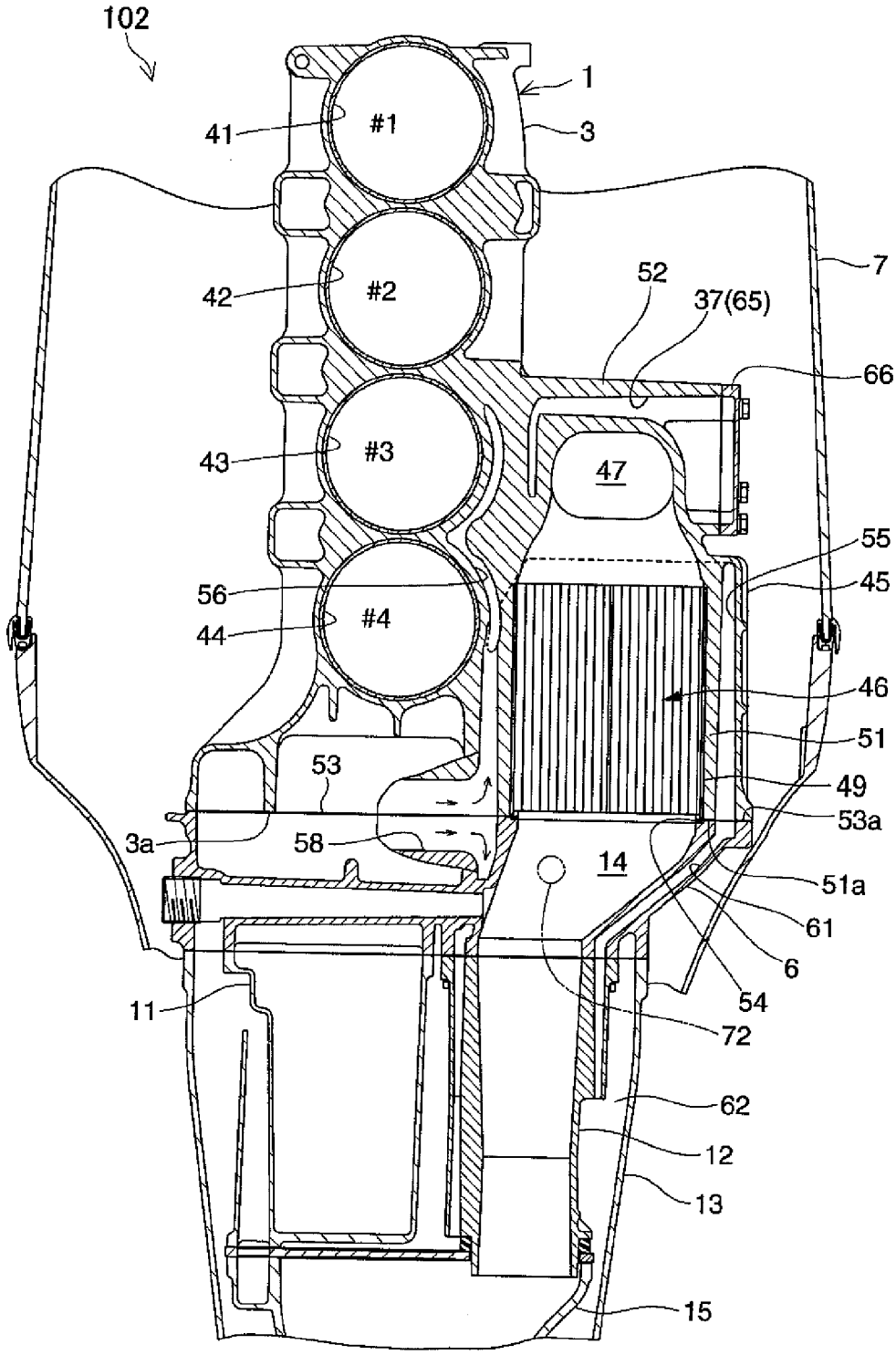
FIG. 5 is a sectional view taken along line V-V in FIG. 1B.

Also, as shown in FIG. 5, the outboard motor main body 102 includes an oil pan 11 disposed below the exhaust guide 6, an exhaust pipe 12, and a muffler 15. The oil pan 11 and the exhaust pipe 12 are housed inside the upper casing 13. An upper portion of the oil pan 11 is attached to a lower portion of the exhaust guide 6. Oil that lubricates the outboard motor main body 102 is stored in the oil pan 11. An upper end portion of the exhaust pipe 12 is attached to a lower portion of a right side portion of the exhaust guide 6. An interior of the exhaust pipe 12 is connected to an exhaust passage 14 that penetrates vertically through the right side portion of the exhaust guide 6. A lower end portion of the exhaust pipe 12 is disposed inside an upper portion of the muffler 15. The exhaust generated at the engine 1 passes through the muffler 15 and is discharged underwater from the propeller 108 (see FIG. 1A). The interior of the exhaust pipe 12, the exhaust passage 14, and an interior of the muffler 15 are respectively portions of the main exhaust passage 109.

Figure 1B:
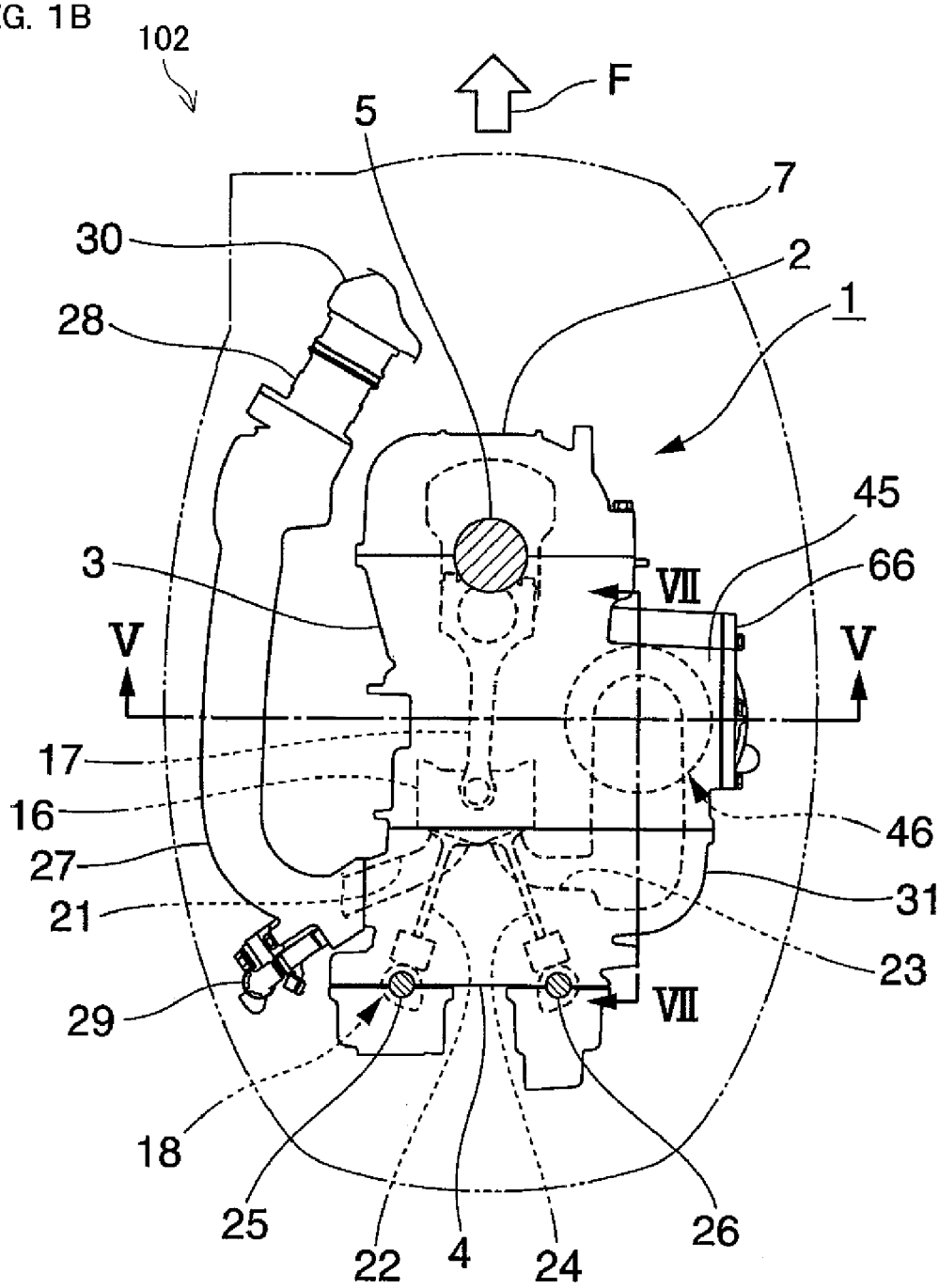
FIG. 1B is a plan view of an outboard motor main body according to the first preferred embodiment of the present invention.
Figure 4:
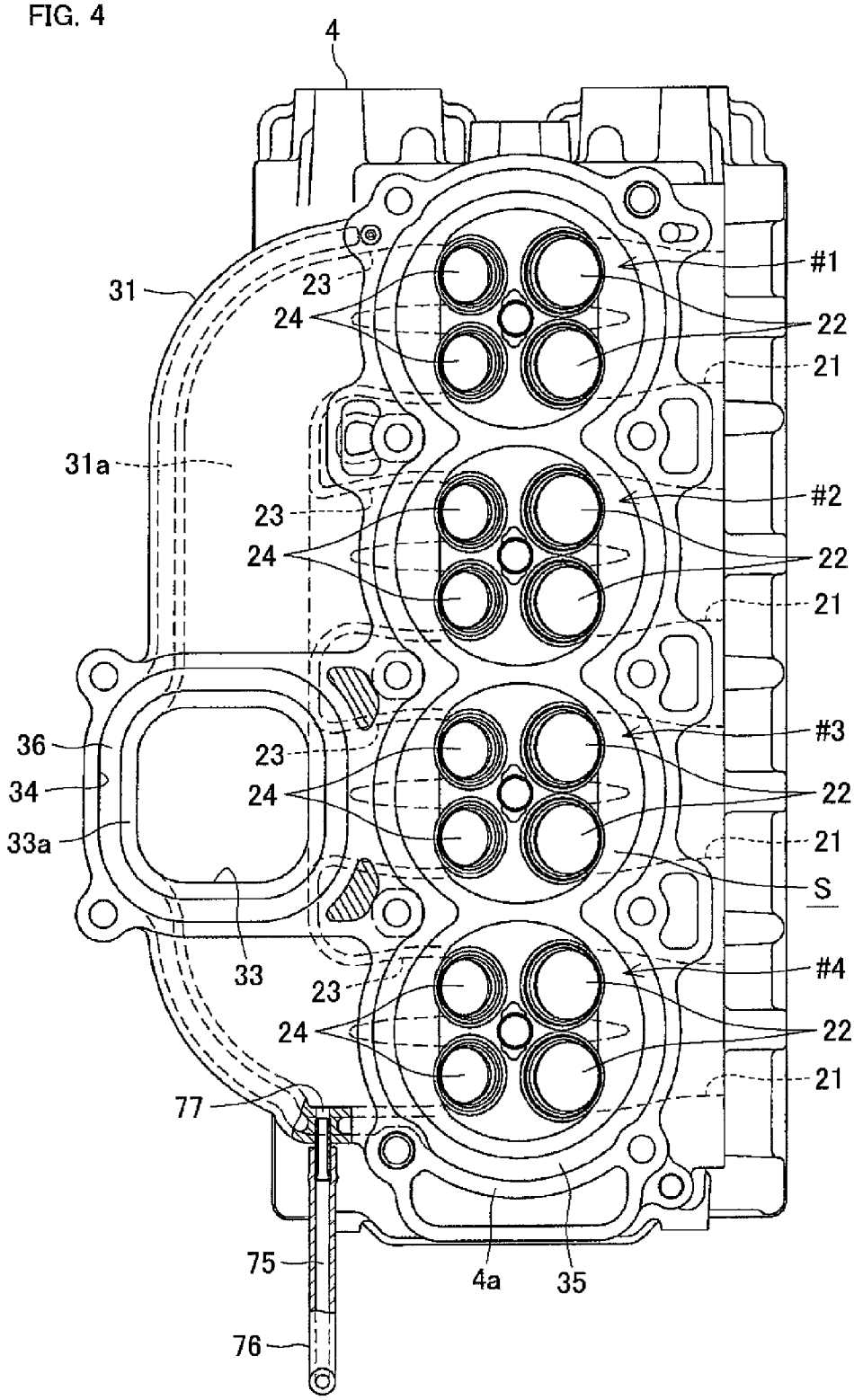
FIG. 4 is front view of the cylinder head according to the first preferred embodiment of the present invention.
Figure 6:
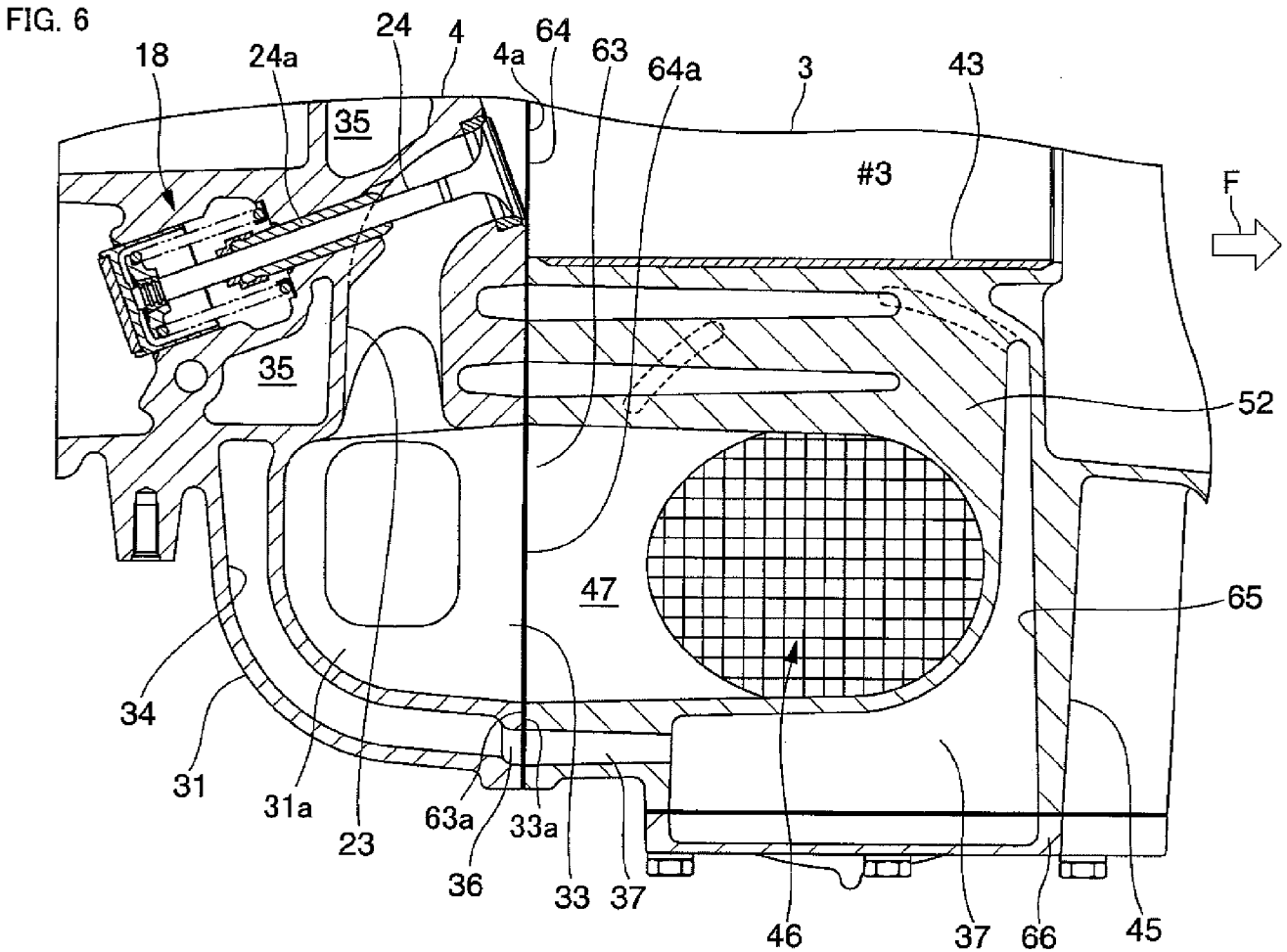
FIG. 6 is a sectional view taken along line VI-VI in FIG. 2.

Also, as shown in FIG. 1B, the engine 1 includes a crankcase 2, a cylinder body 3, a cylinder head 4, and a crankshaft 5. The crankcase 2, the cylinder body 3, and the cylinder head 4 are aligned in a front/rear direction in that order from the front. The engine 1 is, for example, a DOHC (double overhead camshaft) type engine. The engine 1 includes a plurality of pistons 16, a plurality of connecting rods 17, and a valve gear 18. Also, each of the cylinders #1 to #4 includes an intake port 21 and an exhaust port 23. The valve gear 18 includes a plurality of intake valves 22 that respectively open and close the plurality of intake ports 21, a plurality of exhaust valves 24 that respectively open and close the plurality of exhaust ports 23, an intake camshaft 25 that drives the respective intake valves 22, and an exhaust camshaft 26 that drives the respective exhaust valves 24. As shown in FIG. 4, two each of the intake valves 22 and exhaust valves 24 are provided in each of the cylinders #1 to #4. Also, as shown in FIG. 6, each exhaust valve 24 is supported on the cylinder head 4 via a valve guide 24*a*. A tip portion of the valve guide 24*a* is located inside the exhaust port 23.

As shown in FIG. 1B, each intake port 21 opens at a left side surface of the cylinder head 4. Also, the outboard motor main body 102 includes an intake pipe 27, a throttle valve 28, a fuel injector 29, and a surge tank 30. The intake pipe 27 is connected to the respective intake ports 21. The fuel injector 29 is connected to the intake pipe 27 at a vicinity of the respective intake ports 21. The surge tank 30 is connected via the throttle valve 28 to the intake pipe 27. Intake air taken inside the engine cover 7 is supplied to the intake pipe 27 through the surge tank 30 and the throttle valve 28. The intake air supplied to the intake pipe 27 is supplied to the respective intake ports 21.

Figure 2:
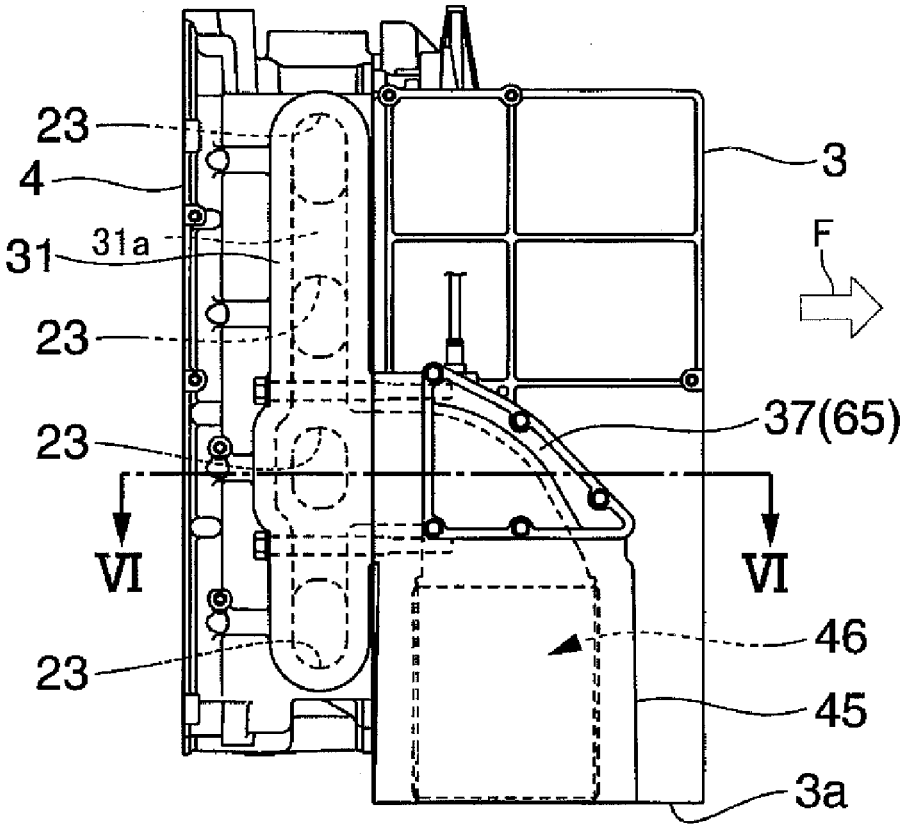
FIG. 2 is aright side view of a cylinder body and a cylinder head according to the first preferred embodiment of the present invention.

Also, as shown in FIG. 2, the cylinder head 4 includes an upstream side exhaust duct 31 provided at a right side portion of the cylinder head 4. The upstream side exhaust duct 31 is arranged to extend vertically. The upstream side exhaust duct 31 is, for example, formed integral or unitary with a portion (a portion of the cylinder head 4) beside the upstream side exhaust duct 31. The upstream side exhaust duct 31 includes an upstream side exhaust passage 31*a* provided in an interior of the upstream side exhaust duct 31. The upstream side exhaust passage 31*a* is an example of a second exhaust passage according to a preferred embodiment of the present invention. The respective exhaust ports 23 are connected to the upstream side exhaust passage 31*a*.

Also, as shown in FIG. 4, the upstream side exhaust duct 31 includes an exhaust exit 33 positioned at substantially the same height as a combustion chamber S corresponding to the third cylinder #3, and an end surface 33*a* that surrounds the exhaust exit 33. Exhaust that is discharged into the upstream side exhaust duct 31 from the respective exhaust ports 23 passes through the interior of the upstream side exhaust duct 31 and is discharged to the cylinder body 3 side (front side) from the exhaust exit 33.

Also, as shown in FIG. 6, the cylinder head 4 includes a mating surface 4*a* with which the cylinder body 3 is overlapped. The mating surface 4*a* is an example of a second mating surface according to a preferred embodiment of the present invention. Also, the end surface 33*a* of the upstream side exhaust duct 31 is an example of a second end surface according to a preferred embodiment of the present invention. The end surface 33*a* and the mating surface 4*a* are, for example, disposed on the same plane. The end surface 33*a* and the mating surface 4*a* are made to be flat, for example, by machining. The cylinder body 3 is overlapped with the end surface 33*a* and the mating surface 4*a*.

Also, as shown in FIG. 6, the cylinder head 4 includes a cooling water passage 34 and a cooling water passage 35. Also, the cylinder body 3 includes a cooling water passage 37. The cooling water passage 34 is provided inside an outer wall of the upstream side exhaust duct 31. The cooling water passage 34 is connected to the cooling water passage 35. Also, the cooling water passage 34 is connected to the cooling water passage 37 via an opening portion 36. As shown in FIG. 4, the exhaust exit 33 is surrounded by the opening portion 36.

Figure 7:
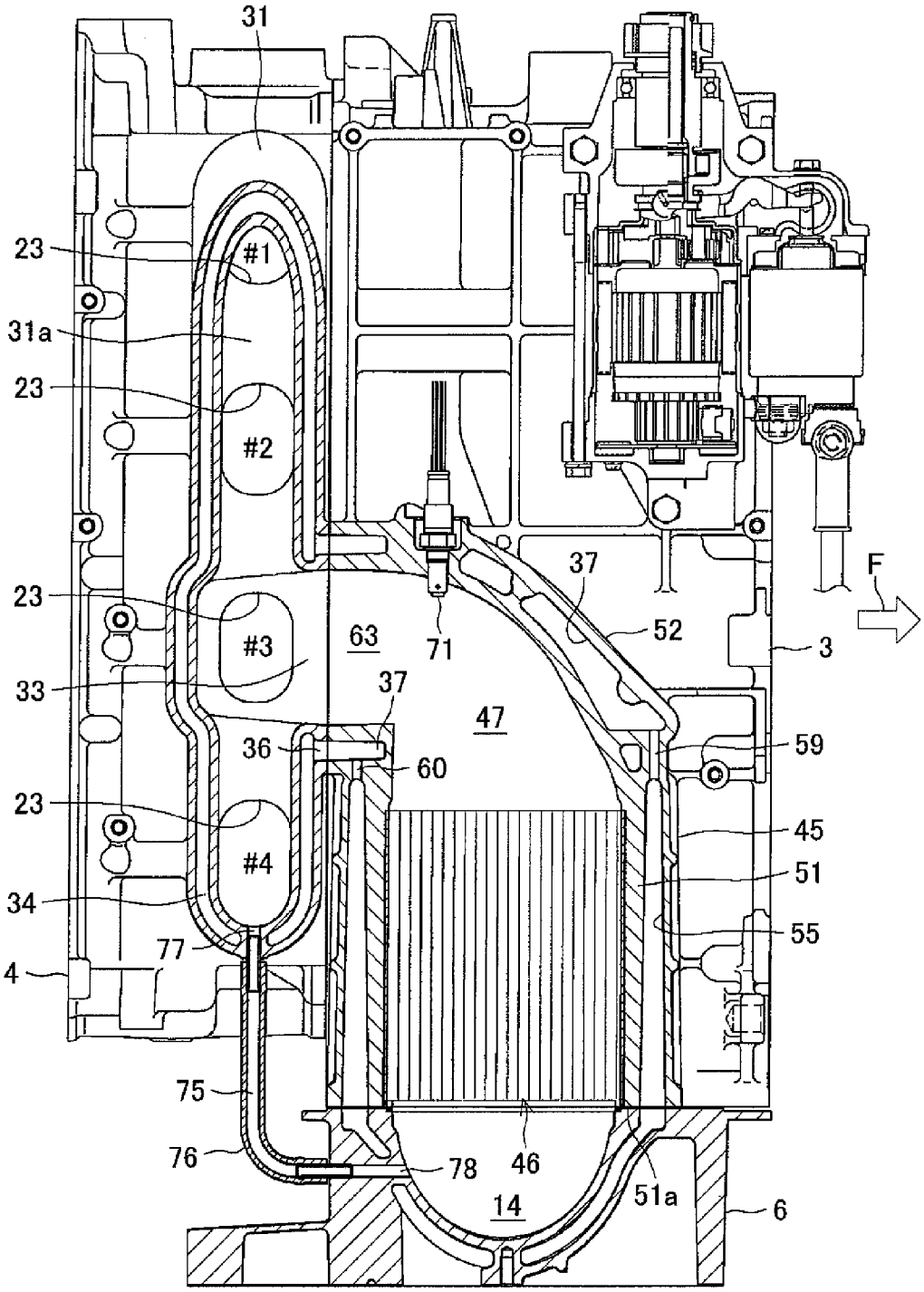
FIG. 7 is a sectional view taken along line VII-VII in FIG. 1B.

Also, as shown in FIG. 7, the outboard motor main body 102 includes a drain passage 75 connected to a lowermost end of the upstream side exhaust duct 31. A portion of the drain passage 75 is defined, for example, by a pipe 76. The pipe 76 is made, for example, of a metal. The pipe 76 is disposed outside the cylinder body 3 and the cylinder head 4. The pipe 76 connects an upstream side drain hole 77 provided in the lowermost end of the upstream side exhaust duct 31, and a downstream side drain hole 78 provided in the exhaust guide 6. The upstream side drain hole 77 is an example of a first end portion according to a preferred embodiment of the present invention. The downstream side drain hole 78 is an example of a second end portion according to a preferred embodiment of the present invention. The upstream side drain hole 77 penetrates vertically through the lowermost end of the upstream side exhaust duct 31. Also, the downstream side drain hole 78 penetrates horizontally through a side portion of the exhaust guide 6. The upstream side exhaust passage 31*a* is connected to the exhaust passage 14 of the exhaust guide 6 via the drain passage 75.

Also, as shown in FIG. 5, the cylinder body 3 includes four cylinder holes 41 to 44 respectively corresponding to the first cylinder to fourth cylinder #1 to #4, and a housing 45 that houses a catalyst 46. The housing 45 is, for example, integral or unitary with a portion of the cylinder body 3 beside the housing 45. The housing 45 includes an exhaust passage 47 in which the catalyst 46 is disposed. The exhaust passage 47 is an example of a first exhaust passage according to a preferred embodiment of the present invention. The exhaust passage 47 is provided in the interior of the engine 1 at a side of the third cylinder #3 and the fourth cylinder #4.

As shown in FIG. 6, the exhaust passage 47 is connected to the exhaust exit 33 of the upstream side exhaust duct 31. The exhaust that is discharged into the upstream side exhaust duct 31 from the respective exhaust ports 23 is thus discharged into the exhaust passage 47 through the upstream side exhaust duct 31. The exhaust discharged into the exhaust passage 47 is cleaned by the catalyst 46. The catalyst 46 is, for example, a three-way catalyst. A three-way catalyst is a catalyst that can simultaneously clean hydrocarbons, nitrogen oxides, and carbon monoxide in the exhaust during combustion in a vicinity of a theoretical air-fuel ratio.

Figure 8:
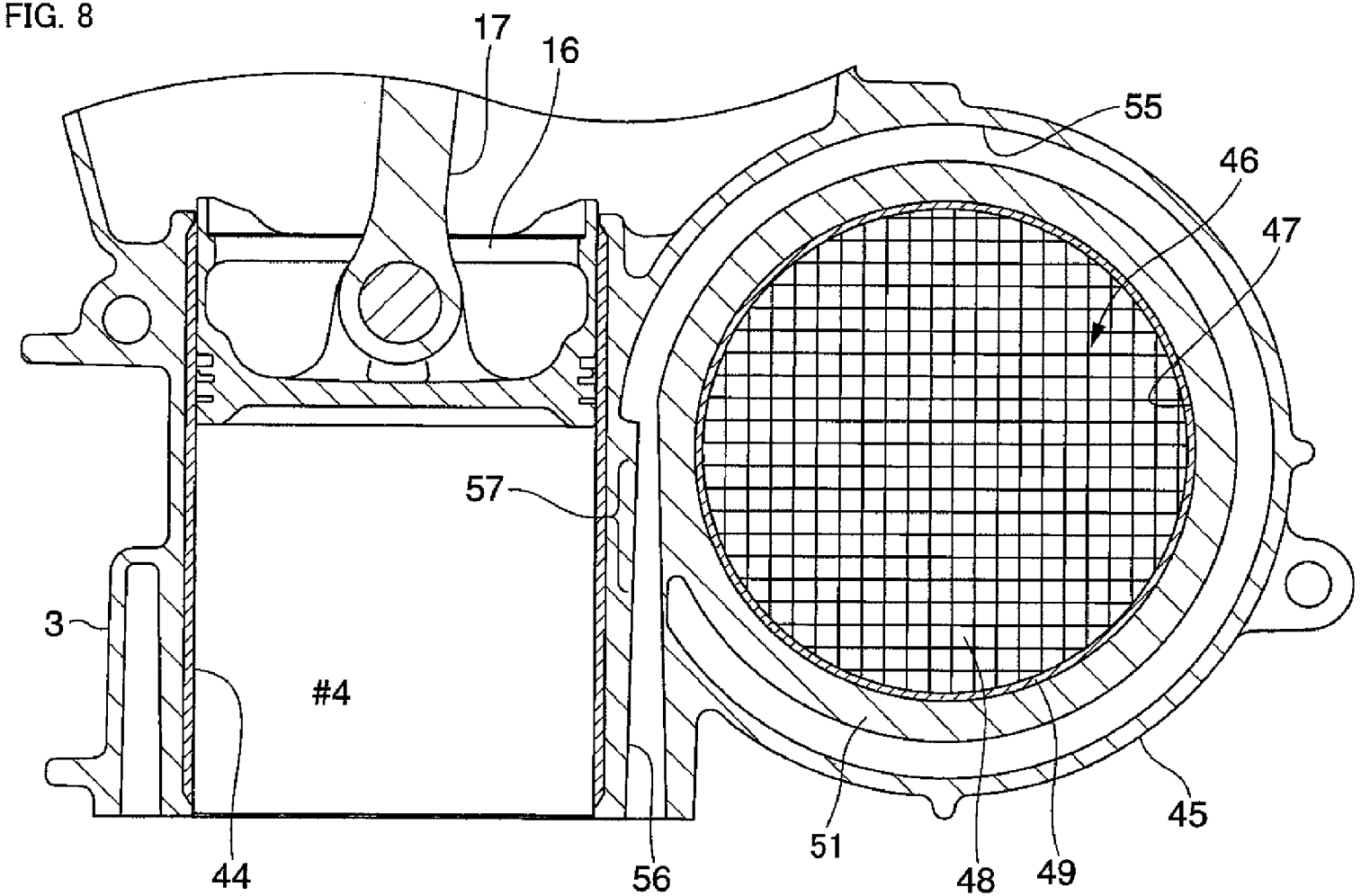
FIG. 8 is a sectional view taken along line VIII-VIII in FIG. 3.

Also, the catalyst 46 is, for example, a metal catalyst that includes a carrier made of a metal. A metal catalyst is high in strength against thermal shock in comparison to a catalyst that includes a carrier made of ceramic. The catalyst 46 is, for example, cylindrical. As shown in FIG. 8, the catalyst 46 includes a carrier 48 and an outer cylinder 49 in which the carrier 48 is inserted. The carrier 48 is made, for example, of stainless steel. The carrier 48 has, for example, a spiral shape. In FIG. 8, etc., illustration of the carrier 48 is simplified.

Figure 9:
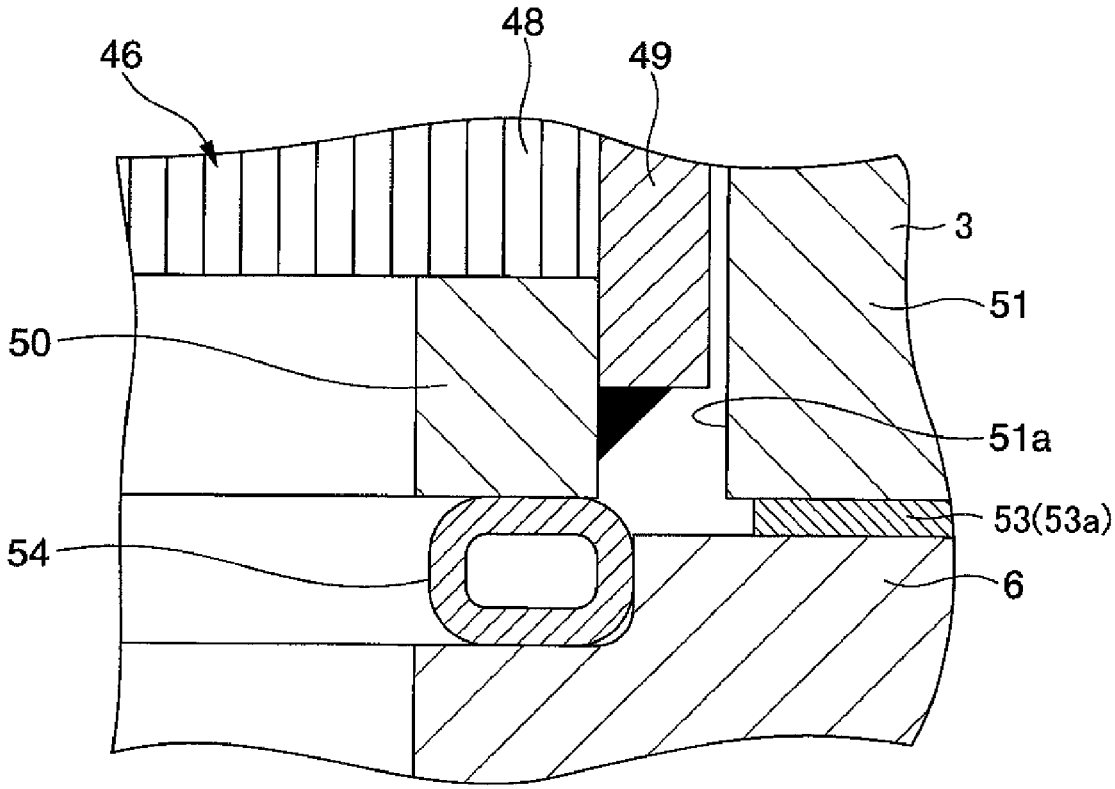
FIG. 9 is a sectional view of a vicinity of a lower end portion of a catalyst according to the first preferred embodiment of the present invention.

Also, as shown in FIG. 9, the catalyst 46 includes a ring 50 that is coaxially fixed to a lower end portion of the outer cylinder 49, for example, by welding. The catalyst 46 is disposed such that a central axis of the catalyst 46 is parallel to a direction in which the exhaust flows. As shown in FIG. 8, an outer shape of the catalyst 46 as viewed in the direction of flow of the exhaust is thus circular.

Also, as shown in FIG. 7, the housing 45 includes a vertically extending tubular portion 51, and a downstream side exhaust duct 52 that extends from an upper end of the tubular portion 51 to the cylinder head 4 side. The tubular portion 51 is an example of a housing portion according to a preferred embodiment of the present invention. The catalyst 46 is housed inside the tubular portion 51. The tubular portion 51 is, for example, integral or unitary with the downstream side exhaust duct 52. An interior of the tubular portion 51 is a portion of the exhaust passage 47. The interior of the tubular portion 51 is connected to the exhaust passage 14 of the exhaust guide 6. Also, the downstream side exhaust duct 52 is connected to the upstream side exhaust duct 31. The respective exhaust ports 23 are connected to the exhaust passage 14 of the exhaust guide 6 via the upstream side exhaust duct 31 and the housing 45.

As shown in FIG. 7, the catalyst 46 is disposed such that an upper end of the catalyst 46 is positioned above a lower end of the fourth cylinder #4. More specifically, the catalyst 46 is disposed such that the upper end of the catalyst 46 is positioned above a lower end of the exhaust port 23 corresponding to the fourth cylinder #4. A lower end of the tubular portion 51 opens at a lower portion of the cylinder body 3. The catalyst 46 is inserted into the tubular portion 51 from below. The outer cylinder 49 of the catalyst 46 is detachably fitted inside the tubular portion 51. The catalyst 46 is held in a state of being sandwiched by the housing 45 and the exhaust guide 6 from above and below.

Also, as shown in FIG. 5, the cylinder body 3 includes a supported surface 3*a* that is supported by the exhaust guide 6. A lower surface 51*a* of the tubular portion 51 and the supported surface 3*a* are, for example, disposed on the same plane. The lower surface 51*a* of the tubular portion 51 and the supported surface 3*a* are made to be flat, for example, by machining. A gasket 53 is sandwiched by the cylinder body 3 and the exhaust guide 6. The gasket 53 seals an interval between the tubular portion 51 and the exhaust guide 6. The gasket 53 includes an extended portion 53*a* that is extended to below the housing 45.

Also, as shown in FIG. 5, an upper end of the catalyst 46 (upper end of the outer cylinder 49) contacts an upper end portion of the tubular portion 51 from below. Also, as shown in FIG. 9, a lower end of the catalyst 46 (lower surface of the ring 50) contacts, from above, a cushioning member 54 disposed on the exhaust guide 6. The cushioning member 54 is an example of an elastic member and an intermediate member according to a preferred embodiment of the present invention. The catalyst 46 is sandwiched from above and below by the housing 45 and the exhaust guide 6 via the cushioning member 54. The catalyst 46 is thereby held by the housing 45 and the exhaust guide 6 via the cushioning member 54.

As shown in FIG. 9, the cushioning member 54 is, for example, a ring including a pipe made of a metal. The cushioning member 54 has elasticity. The cushioning member 54 is elastically deformed by being sandwiched by the catalyst 46 and the exhaust guide 6. Dimensional variation of the catalyst 46 in the up/down direction (axial direction) is absorbed by the cushioning member 54. Also, dimensional change of the catalyst 46 caused by temperature change is absorbed by the cushioning member 54. Loads, applied to the catalyst 46, the housing 45, and the exhaust guide 6 in accompaniment with temperature change, are thereby reduced. Also, an inner circumferential surface 51*a* of the tubular portion 51 surrounds the outer cylinder 49 across an interval in a radial direction. Thermal expansion of the catalyst 46 in the radial direction is thereby allowed.

Also, as shown in FIG. 7, the tubular portion 51 includes a cooling water passage 55 disposed in an outer wall of the tubular portion 51. Also, the cooling water passage 37 is provided in an outer wall of the downstream side exhaust duct 52. An upper end portion of the cooling water passage 55 is connected to the cooling water passage 37 via passages 59 and 60. Also, as shown in FIG. 8, the cooling water passage 55 surrounds the catalyst 46. In between the fourth cylinder #4 and the catalyst 46, the cooling water passage 55 is connected to a cooling water passage 56 provided in the cylinder body 3. That is, the cooling water passage 55 and the cooling water passage 56 share a shared portion 57 positioned between the fourth cylinder #4 and the catalyst 46. The cooling water passage 56 is an example of a first cooling water passage according to a preferred embodiment of the present invention. The cooling water passage 55 is an example of a second cooling water passage according to a preferred embodiment of the present invention.

Also, as shown in FIG. 5, the cylinder body 3 includes a cooling water supply passage 58 provided inside a lower portion of the cylinder body 3. A lower end portion of the cooling water passage 55 and a lower end portion of the cooling water passage 56 are connected to the cooling water supply passage 58. Cooling water that flows through the cooling water supply passage 58 is supplied to the cooling water passage 55 and the cooling water passage 56. Also, a portion of the cooling water passage 55 is disposed at an opposite side of the fourth cylinder #4 with respect to the catalyst 46. This portion of the cooling water passage 55 is connected via a cooling water passage 61, provided in an interior of the exhaust guide 6, to a drain chamber 62 provided inside the upper casing 13.

Also, as shown in FIG. 7, the downstream side exhaust duct 52 includes an exhaust entrance 63 connected to an exhaust exit 33 of the upstream side exhaust duct 31. The exhaust exit 33 and the exhaust entrance 63 are disposed above a lowermost end of the upstream side exhaust duct 31. Exhaust discharged from the upstream side exhaust duct 31 passes through the exhaust entrance 63 and enters into the downstream side exhaust duct 52. The exhaust that enters into the downstream side exhaust duct 52 flows toward the front inside the downstream side exhaust duct 52 and its direction is converted downward by the downstream side exhaust duct 52. The exhaust that enters the downstream side exhaust duct 52 is thereby guided to the catalyst 46 positioned below the downstream side exhaust duct 52.

Figure 3:
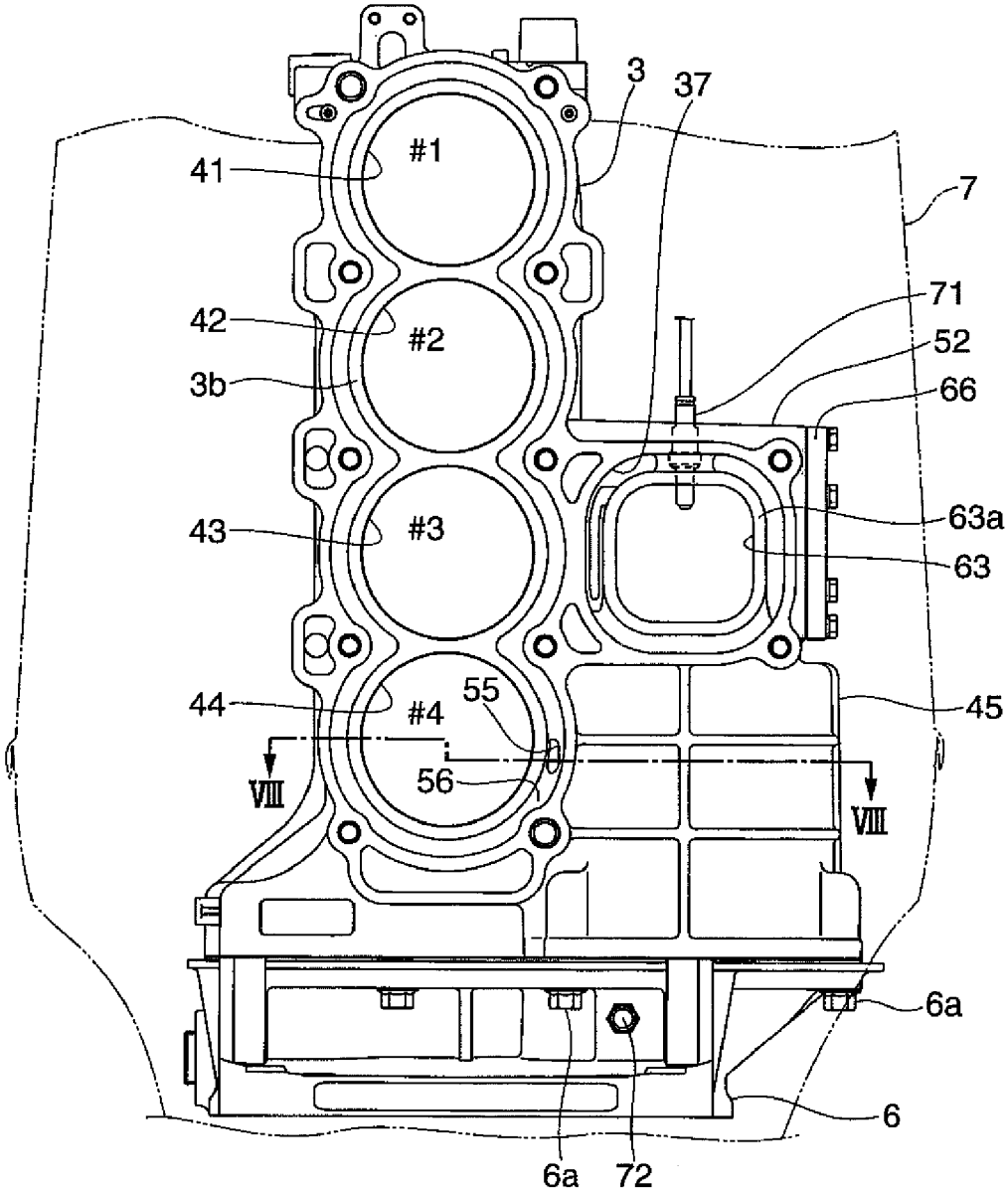
FIG. 3 is a rear view of the cylinder body according to the first preferred embodiment of the present invention.

Also, as shown in FIG. 3, the downstream side exhaust duct 52 includes an end surface 63*a* disposed at a periphery of the exhaust entrance 63. Also, the cylinder body 3 includes a mating surface 3*b* with which the cylinder head 4 is overlapped. The mating surface 3*b* is an example of a first mating surface according to a preferred embodiment of the present invention. Also, the end surface 63*a* is an example of a first end surface according to a preferred embodiment of the present invention. The end surface 63*a* and the mating surface 3*b* are, for example, disposed on the same plane. The end surface 63*a* and the mating surface 3*b* are made to be flat, for example, by machining. As shown in FIG. 6, a gasket 64 is sandwiched by the end surface 63*a* of the downstream side exhaust duct 52 and the end surface 33*a* of the upstream side exhaust duct 31. The gasket 64 includes an extended portion 64*a* that extends to the upstream side exhaust duct 31 and the downstream side exhaust duct 52 side. The extended portion 64*a* seals an interval between the end surface 63*a* of the downstream side exhaust duct 52 and the end surface 33*a* of the upstream side exhaust duct 31.

Also, as shown in FIG. 6, the cooling water passage 37 of the downstream side exhaust duct 52 is disposed at a periphery of the exhaust passage 47. The cooling water passage 37 includes a recessed portion 65 having an opening that is directed to the right. The opening of the recessed portion 65 is closed by a lid member 66. Also, as shown in FIG. 7, the cooling water passage 55 of the tubular portion 51 is connected to the cooling water passage 34 of the upstream side exhaust duct 31 via the cooling water passage 37 of the downstream side exhaust duct 52.

Also, as shown in FIG. 7, an oxygen concentration sensor 71 is attached to an upper portion of the downstream side exhaust duct 52. The oxygen concentration sensor 71 is disposed at an upstream side of the catalyst 46. Also, as shown in FIG. 5, an abnormality detection sensor 72 is disposed at a downstream side of the catalyst 46. The abnormality detection sensor 72 is, for example, a sensor that detects a temperature of the exhaust. Abnormality of the oxygen concentration sensor 71 and abnormality of the catalyst 46 are detected by the abnormality detection sensor 72.

Figure 10:
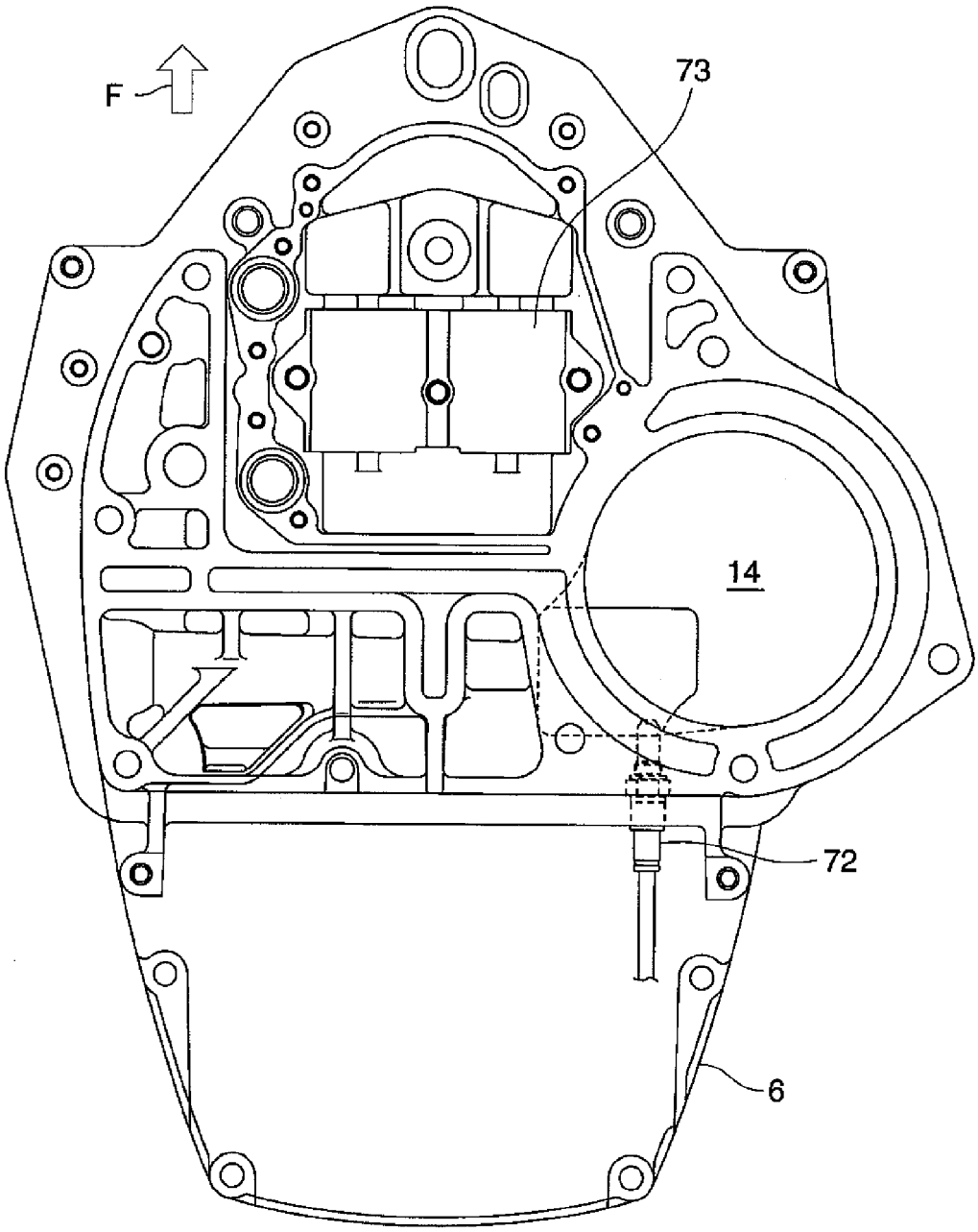
FIG. 10 is a plan view of an exhaust guide according to the first preferred embodiment of the present invention.

As shown in FIG. 10, the abnormality detection sensor 72 is attached to a rear portion of the exhaust guide 6. Also, a mounting member 73 arranged to mount the outboard motor main body 102 to the hull H1 is attached to a front portion of the exhaust guide 6. Thus, in comparison to a case where the abnormality detection sensor 72 is attached to the front portion of the exhaust guide 6, attachment/detachment work of the abnormality detection sensor 72 with respect to the exhaust guide 6 is easy. Also, the abnormality detection sensor 72 is attached to the rear portion of the exhaust guide 6, and thus, in comparison to a case where the abnormality detection sensor 72 is attached to a side portion of the exhaust guide 6, a width (length in the right/left direction) of the outboard motor main body 102 is reduced. The outboard motor 101 is thereby made compact.

As described above, with the present preferred embodiment, the catalyst 46 is inserted from below into the housing 45 provided in the cylinder body 3. Installation of the catalyst 46 is thus simple in comparison to a case where the catalyst 46 is disposed inside an exhaust manifold. Also, the catalyst 46 is held in a state of being sandwiched from above and below by the housing 45 and the exhaust guide 6. An exhaust manifold arranged to hold the catalyst 46 is thus unnecessary. Increase of the number of parts of the outboard motor 101 is thereby prevented. Also, the catalyst 46 is held by the cylinder body 3 and the exhaust guide 6, and the catalyst 46 can thus be held without increasing the number of parts of the outboard motor as long as the outboard motor is provided with the cylinder body and the exhaust guide.

Also, the catalyst 46 is held by the cylinder body 3. The cylinder body 3 ordinarily has a higher rigidity than an exhaust manifold. Thus, even if the cylinder body 3 is warmed by heat of the exhaust and a thermal stress is applied to the cylinder body 3, deformation is unlikely to occur in the cylinder body 3. Also, even when the hull H1 is swung up and down by waves and a large force caused by vibration of the catalyst 46 is applied to the cylinder body 3, displacement is unlikely to occur in the cylinder body 3. Degradation of the sealing property at a portion of connection of the cylinder body 3 and the cylinder head 4 and at a portion of connection of the cylinder body 3 and the exhaust guide 6 is thus prevented.

Also, with the present preferred embodiment, the catalyst 46 is detachably installed in the housing 45. The catalyst 46 can thus be removed from the housing 45 by moving the cylinder body 3 above the exhaust guide 6. Just the catalyst 46 can thereby be exchanged. Thus, in comparison to a case where the cylinder body 3 must be exchanged together with the catalyst 46, the cost required for exchange of the catalyst 46 is reduced.

Also, with the present preferred embodiment, the tubular portion 51 of the housing 45 that houses the catalyst 46 is disposed at the side of the fourth cylinder #4. The cylinder body 3 includes the cooling water passage 55 disposed in the periphery of the catalyst 46 and the cooling water passage 56 disposed in the periphery of the fourth cylinder #4. The cooling water passage 55 and the cooling water passage 56 share a portion of each other. That is, the cooling water passage 55 and the cooling water passage 56 are connected at a location between the fourth cylinder #4 and the catalyst 46. Thus, in comparison to case where the cooling water passage 55 and the cooling water passage 56 are not connected at a location between the fourth cylinder #4 and the catalyst 46, a distance between the fourth cylinder #4 and the catalyst 46 is shortened. The width (length in the right/left direction) of the engine 1 is thereby reduced.

Also, with the present preferred embodiment, the catalyst 46 is sandwiched from above and below by the cylinder body 3 and the exhaust guide 6 via the cushioning member 54. The cushioning member 54 has elasticity. Dimensional variations of the catalyst 46 in the vertical direction are thereby absorbed by the cushioning member 54. A high dimensional precision is thus not required of the catalyst 46. Manufacturing cost of the catalyst 46 is thereby reduced. The outboard motor 101 is thereby reduced in cost.

Also, with the present preferred embodiment, the cylinder body 3 includes the mating surface 3*b*, and the end surface 63*a* disposed on the same plane as the mating surface 3*b*. Also, the cylinder head 4 includes the mating surface 4*a* overlapped with the mating surface 3*b*, and the end surface 33*a* disposed on the same plane as the mating surface 4*a*. The exhaust entrance 63 of the downstream side exhaust duct 52 opens at the end surface 63*a*. Also, the exhaust exit 33 of the upstream side exhaust duct 31 opens at the end surface 33*a*. The exhaust entrance 63 and the exhaust exit 33 are thus connected by coupling the cylinder body 3 and the cylinder head 4. A member arranged to guide the exhaust from the exhaust exit 33 to the exhaust entrance 63 is thus unnecessary. Also, the exhaust entrance 63 and the exhaust exit 33 are respectively provided in the cylinder body 3 and cylinder head 4, each of which has a high rigidity, and degradation of the sealing property at the portion of connection of the exhaust entrance 63 and the exhaust exit 33 is thus prevented.

Also, with the present preferred embodiment, the outer shape of the catalyst 46 as viewed from the direction of flow of the exhaust is circular. Thus, in comparison to a case where the outer shape of the catalyst 46 is, for example, elliptical, a work of forming the carrier 48 to a spiral shape is comparatively simple and manufacture of the carrier 48 is easy. Also, the catalyst 46 is disposed in the interior of the engine 1. The width of the engine 1 may thus be large in comparison to the case where the outer shape of the catalyst 46 is, for example, elliptical. However, the width of the engine 1 is reduced by the cooling water passage 55 and the cooling water passage 56 sharing a portion of each other as mentioned above. Thus, even if the shape of the catalyst 46 is circular, increase of the width of the engine 1 is prevented.

Also, with the present preferred embodiment, the exhaust discharged from the engine 1 passes through the interior of the upstream side exhaust duct 31 (upstream side exhaust passage 31*a*). Liquid water may thus form inside the upstream side exhaust duct 31. Specifically, the exhaust that is generated in accompaniment with the combustion of a fuel containing hydrogen atoms, such as gasoline, contains water. When such exhaust containing water is cooled, liquid water may form due to condensation. For example, when the engine 1 is rotating at low speed or when the output of the engine 1 is low, the temperature inside the upstream side exhaust duct 31 is comparatively low. The exhaust discharged from the engine 1 is thus cooled and liquid water may form inside the upstream side exhaust duct 31. Also, when the engine 1 is stopped, the temperature inside the upstream side exhaust duct 31 decreases. Dew condensation may thus occur when the exhaust present inside the upstream side exhaust duct 31 contacts the inner surface of the upstream side exhaust duct 31 after the engine 1 is stopped.

Also, with the present preferred embodiment, the upper end of the catalyst 46 is positioned above the lower end of the fourth cylinder #4. The upstream side exhaust duct 31 defines an exhaust passage between the catalyst 46 and the fourth cylinder #4. The upstream side exhaust duct 31 thus includes a rising portion that rises toward the catalyst 46 from the fourth cylinder #4. Thus, when liquid water forms inside the upstream side exhaust duct 31, the liquid water may flow in reverse inside the upstream side exhaust duct 31 and enter inside the fourth cylinder #4. When the liquid water enters inside the fourth cylinder #4, the fourth cylinder #4 may misfire. Also, when the fourth cylinder #4 misfires, operation of the engine 1 is unstable.

For example, if the catalyst 46 is disposed such that the upper end of the catalyst 46 is positioned below the lower end of the fourth cylinder #4, the rising portion is eliminated from the upstream side exhaust duct 31. Entry of liquid water into the fourth cylinder #4 such as described above is thereby prevented. However, if the position of the catalyst 46 is low, a distance between the catalyst 46 and an exit of the main exhaust passage 109 is short. Thus, in comparison to the case where the catalyst 46 is disposed at a high position, liquid water that enters into the main exhaust passage 109 from the exit of the main exhaust passage 109 attaches more readily to the catalyst 46. When liquid water becomes attached to the catalyst 46, the catalyst 46 may degrade in performance.

For lowering the position of the catalyst 46, locating the catalyst 46 inside the upper casing 13 such that the catalyst 46 is positioned at the same height as the oil pan 11 may be considered. However, space inside the upper casing 13 is limited. Thus, in this case, the oil pan 11 is made small in volume and the storage amount of oil is reduced. The oil pan 11 may thus not be able to store an adequate amount of oil for lubricating the outboard motor main body 102. It is thus preferable for the catalyst 46 to be disposed at a high position.

In the present preferred embodiment, the drain passage 75 is connected to the lowermost end of the upstream side exhaust duct 31. The liquid water that forms inside the upstream side exhaust duct 31 thus flows down due to its own weight and enters the exhaust passage 14 of the exhaust guide 6 through the drain passage 75. The liquid water that forms inside the upstream side exhaust duct 31 is thus discharged. Misfiring of the fourth cylinder #4 is thus prevented. Also, corrosion of the exhaust valve 24 and the valve guide 24*a* corresponding to the fourth cylinder #4 is prevented. The sealing performance when the exhaust valve 24 closes the exhaust port 23 is thereby maintained. Also, smooth movement of the exhaust valve 24 with respect to the valve guide 24*a* is maintained. Further, corrosion of the piston ring and the inner surface of the fourth cylinder #4 is prevented because the entry of liquid water into the fourth cylinder #4 is prevented. Fixation of the piston ring is thereby prevented. Early wear of the inner surface of the fourth cylinder #4 is also prevented. Yet further, the entry of liquid water into the oil pan 11 through the crankcase 3 is prevented because the entry of liquid water into the fourth cylinder #4 is prevented. The entry of liquid water into the oil is thereby prevented. Degradation of the lubricating property of the oil is thereby prevented.

Also, with the present preferred embodiment, the housing 45 is arranged such that the exhaust passes through the catalyst 46 from an upper side to a lower side. That is, the exhaust that enters inside the housing 45 passes through the catalyst 46 while flowing in a direction parallel to a rotational axis of the crankshaft 5. Thus, when liquid water moves to an upper side of the catalyst 46 or when liquid water forms above the catalyst 46, the liquid water flows downward through the catalyst 46. Retention of liquid water above the catalyst 46 is thereby prevented.

Discharge of water from the upstream side exhaust duct 31 is continued even when the outboard motor 101 is tilted up, for example, for storage of the outboard motor 101. Retention of liquid water inside the upstream side exhaust duct 31 when the engine 1 is stopped and attachment of this liquid water on the oxygen concentration sensor 71 after starting of the engine 1 are thus prevented. Degradation of performance of the oxygen concentration sensor 71 is thereby prevented. Also, the oxygen concentration sensor 71 is attached to the upper portion of the downstream side exhaust duct 52, and thus, even if liquid water enters inside the exhaust passage 47, this liquid water is unlikely to contact the oxygen concentration sensor 71.

Second Preferred Embodiment

With the first preferred embodiment, a case where the catalyst 46 is sandwiched from above and below by the cylinder body 3 and the exhaust guide 6 via the cushioning member 54 was described. However, the catalyst 46 may instead be fixed to the housing 45 by press fitting as shown in FIG. 11.

Figure 11:
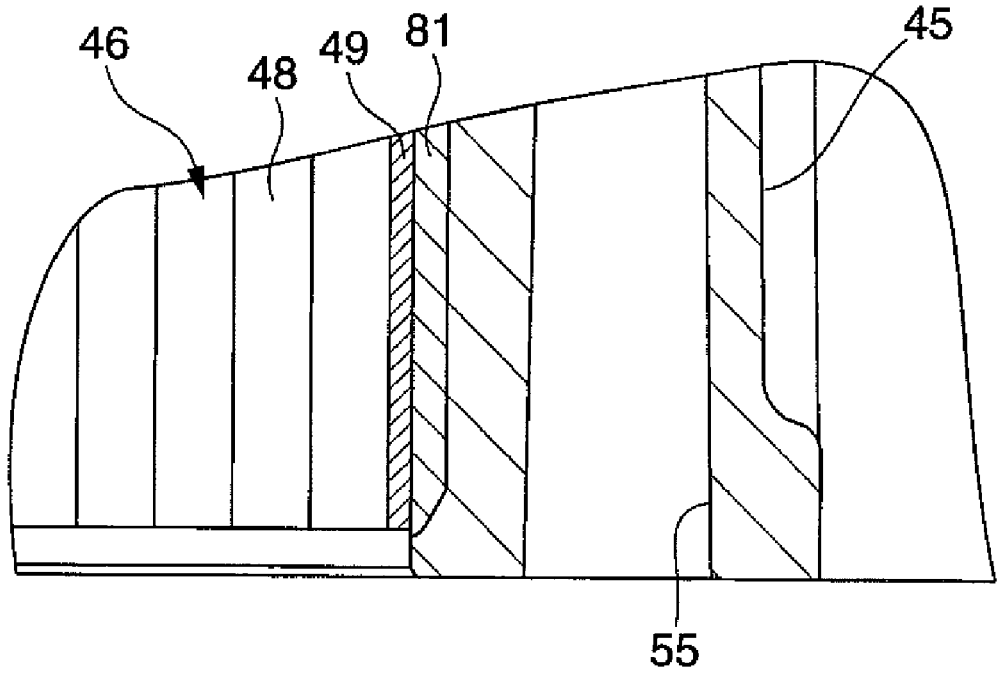
FIG. 11 is a sectional view of a supporting structure of a catalyst according to a second preferred embodiment of the present invention.

FIG. 11 is a sectional view of a supporting structure of the catalyst 46 according to a second preferred embodiment of the present invention. In FIG. 11, component portions equivalent to respective portions shown in FIG. 1 to FIG. 10 are provided with the same reference symbols as in FIG. 1, etc., and description thereof shall be omitted.

A cylindrical sleeve 81 is joined to an inner peripheral portion of the housing 45, for example, by insert molding. The sleeve 81 is made, for example, of an iron-based metal material. The catalyst 46 is inserted inside the sleeve 81. The catalyst 46 is fixed to the sleeve 81, for example, by press fitting. The insertion of the catalyst 46 with respect to the sleeve 81 may be performed at room temperature or in a state where the sleeve 81 is heated. That is, the catalyst 46 may be fixed to the sleeve 81 by thermal insertion.

By fixing the catalyst 46 to the housing 45 by press fitting, the catalyst 46 can be held reliably without dependence on dimensional tolerances of the catalyst 46. Also, the sleeve 81 is made of the iron-based metal material. The housing 45 is made, for example, of an aluminum alloy. The carrier 48 is made, for example, of stainless steel. A difference between thermal expansion coefficients of iron and stainless steel is smaller than a difference between thermal expansion coefficients of aluminum and stainless steel. That is, the difference between the thermal expansion coefficients of the sleeve 81 and the catalyst 46 is smaller than the difference between the thermal expansion coefficients of the housing 45 and the catalyst 46. The catalyst 46 can thus be held with stability in comparison to a case where the sleeve 81 is not provided.

Third Preferred Embodiment

With the first preferred embodiment, a case where the drain passage 75 is connected to the lowermost end of the upstream side exhaust duct 31 was described. However, a valve that controls the flow of fluid in the drain passage 75 may be connected to the drain passage 75. Specifically, the drain passage 75 may be connected to the lowermost end of the upstream side exhaust duct 31 via a valve 301 as shown in FIG. 12 and FIG. 13.

Figure 12:
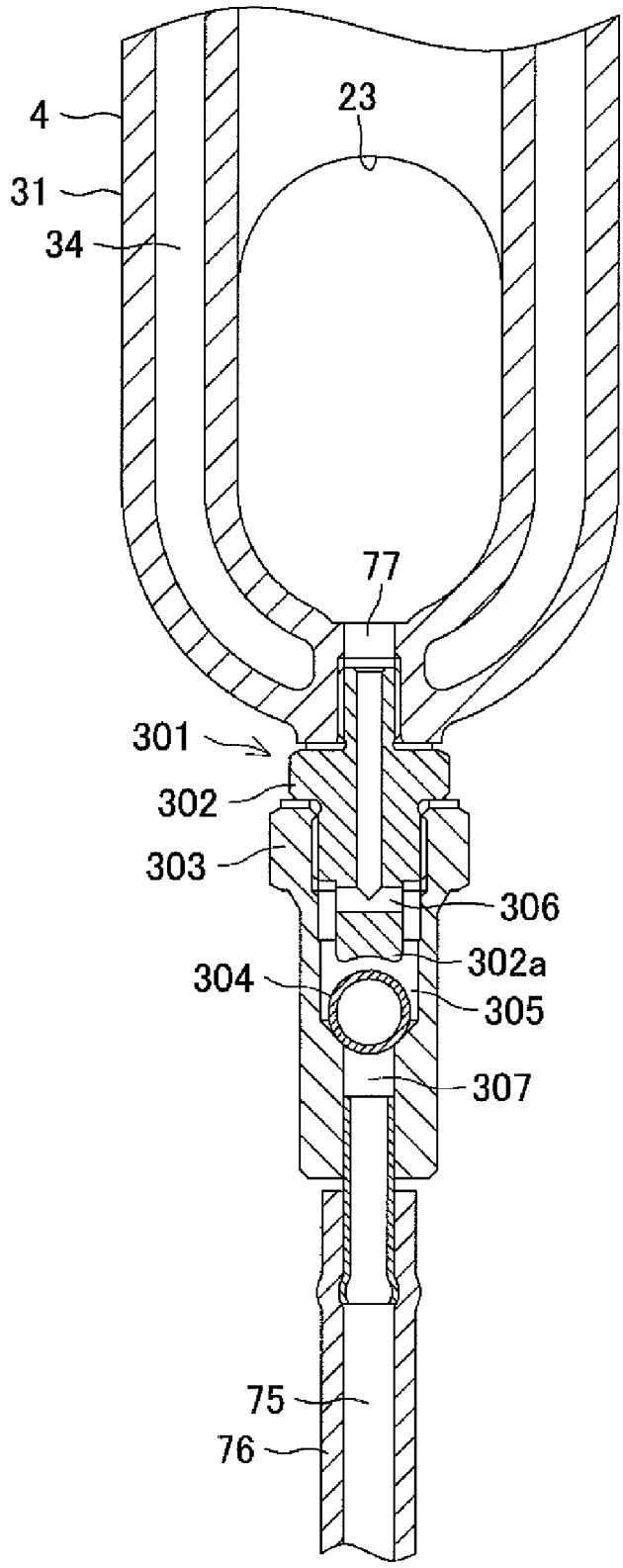
FIG. 12 is a sectional view of a valve according to a third preferred embodiment of the present invention.
Figure 13:
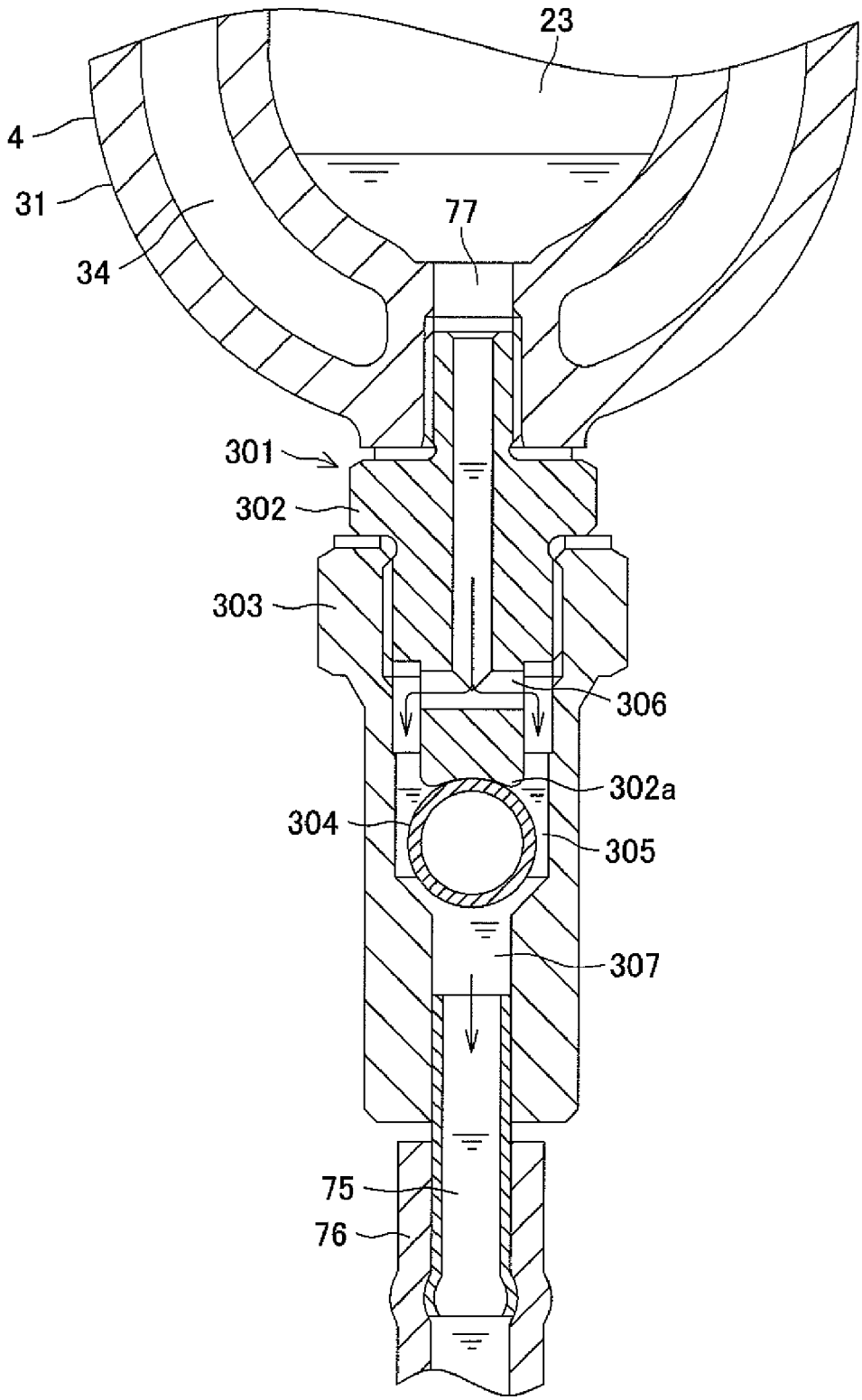
FIG. 13 is a sectional view of the valve according to the third preferred embodiment of the present invention.

Each of FIG. 12 and FIG. 13 is a sectional view of the valve 301 according to a third preferred embodiment of the present invention. FIG. 12 shows a state where the valve 301 is closed, and FIG. 13 shows a state where the valve 301 is open. In FIG. 12 and FIG. 13, component portions equivalent to respective portions shown in FIG. 1 to FIG. 11 are provided with the same reference symbols as in FIG. 1, etc., and description thereof shall be omitted.

The valve 301 includes a first member 302, a second member 303, and a float 304. The first member 302 is coupled to the upstream side exhaust duct 31. The second member 303 is coupled to the pipe 76. The second member 303 is, for example, tubular. A lower portion of the first member 302 is fitted inside an upper portion of the second member 303. The first member 302 is coupled to the second member 303, for example, by a screw. Also, the float 304 is disposed in an interior of the second member 303. The float 304 is, for example, a hollow sphere. The float 304 is made, for example, of ceramic. The float 304 is disposed below a lower end 302*a* of the first member 302.

Also, the valve 301 includes a water chamber 305, a first flow passage 306, and a second flow passage 307. An upper portion of the first flow passage 306 is connected to the interior of the upstream side exhaust duct 31. A lower portion of the first flow passage 306 is connected to the water chamber 305 at a position above the lower end 302*a* of the first member 302. The water chamber 305 is thus connected to the interior of the upstream side exhaust duct 31 via the first flow passage 306. An upper portion of the second flow passage 307 is connected to the water chamber 305. A lower portion of the second flow passage 307 is connected to the interior of the pipe 76. The water chamber 305 is thus connected to the interior of the pipe 76 via the second flow passage 307. The water chamber 305 is, for example, a vertically extending cylinder. The float 304 is disposed in the water chamber 305. A diameter of the float 304 is less than a diameter of the water chamber 305.

A portion connecting the water chamber 305 and the first flow passage 306 is constantly maintained in a state allowing passage of a fluid. Also, a portion connecting the water chamber 305 and the second flow passage 307 is opened and closed by the float 304. Specifically, liquid water that forms inside the upstream side exhaust duct 31 enters into the water chamber 305 through the first flow passage 306. When no less than a fixed amount of liquid water becomes retained in the water chamber 305, the float 304 floats due to buoyancy, and the portion connecting the water chamber 305 and the second flow passage 307 is opened. The liquid water inside the water chamber 305 thus flows into the pipe 76. Also, when the float 304 floats and moves to a predetermined position, an upper portion of the float 304 contacts the lower end 302*a* of the first member 302 as a stopper. The portion connecting the water chamber 305 and the first flow passage 306 is thereby maintained in the state allowing passage of fluid.

On the other hand, when the water amount inside the water chamber 305 is low, the portion connecting the water chamber 305 and the second flow passage 307 is closed by the float 304. The flow of liquid water from the upstream side exhaust duct 31 to the pipe 76 is thereby cut off. Also, even when there is a certain amount of liquid water inside the water chamber 305, if an exhaust pressure inside the upstream side exhaust duct 31 is high, the float 304 is pressed downward by the exhaust pressure and the portion of connection of the water chamber 305 and the second flow passage 307 is closed by the float 304. Thus, in the case where the exhaust pressure inside the upstream side exhaust duct 31 is high, the flow of liquid water from the upstream side exhaust duct 31 to the pipe 76 is cut off. The valve 301 is thus opened and closed according to the water amount inside the valve 301 and the exhaust pressure inside the upstream side exhaust duct 31.

For example, when the engine 1 is rotating at low speed or when the output of the engine 1 is low, liquid water may form inside the upstream side exhaust duct 31. In such an operation state of the engine 1, the exhaust pressure inside the upstream side exhaust duct 31 is comparatively low. Thus, when liquid water of no less than the fixed amount becomes retained in the valve 301, the valve 301 opens and the liquid water flows into the pipe 76 from the upstream side exhaust duct 31. The liquid water is thereby discharged from the upstream side exhaust duct 31. On the other hand, when, for example, the engine 1 is rotating at high speed or when the output of the engine 1 is high, liquid water is unlikely to form inside the upstream side exhaust duct 31. In such an operation state of the engine 1, the exhaust pressure inside the upstream side exhaust duct 31 is comparatively high. Thus, in such an operation state of the engine 1, the valve 301 is maintained in the closed state and the flow of fluid from the upstream side exhaust duct 31 to the pipe 76 is cut off. By the above, just liquid water is discharged from the upstream side exhaust duct 31.

Although preferred embodiments of the present invention have been described above, the present invention is not limited to the contents of the above-described preferred embodiments, and various changes are possible within the scope of the claims. For example, with each of the above-described preferred embodiments, a case where the catalyst 46 is a metal catalyst was described. However, the catalyst 46 is not restricted to a metal catalyst and may be a catalyst of another form, such as a catalyst that includes a carrier made of ceramic, etc.

Also, with each of the above-described preferred embodiments, a case where the downstream side exhaust duct 52 is integral or unitary with a portion of the cylinder body 3 beside the downstream side exhaust duct 52 was described. Also, a case where the upstream side exhaust duct 31 is integral or unitary with a portion of the cylinder head 4 beside the upstream side exhaust duct 31 was described. However, each of the downstream side exhaust duct 52 and the upstream side exhaust duct 31 may be a separate member from the cylinder body 3 and the cylinder head 4.

Figure 14:
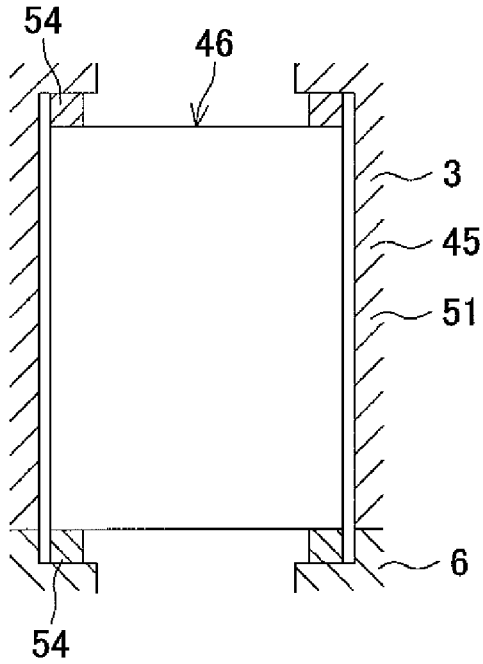
FIG. 14 is schematic view of a supporting structure of a catalyst according to a fourth preferred embodiment of the present invention.
Figure 15:
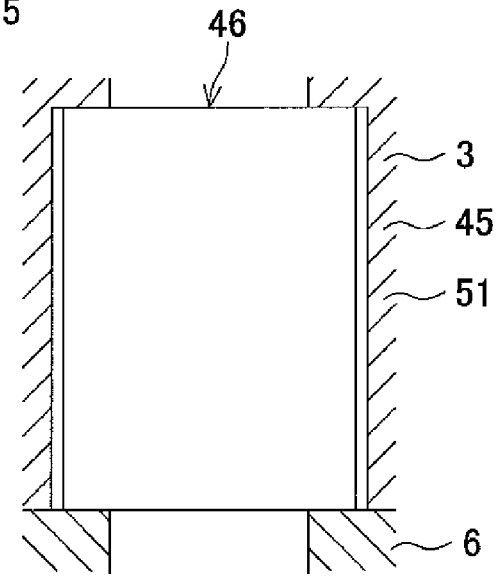
FIG. 15 is schematic view of a supporting structure of a catalyst according to a fifth preferred embodiment of the present invention.

Also, with each of the above-described preferred embodiments, a case where the cushioning member 54 is disposed between the lower end of the catalyst 46 and the exhaust guide 6 was described. However, as shown in FIG. 14, cushioning members 54 may be disposed between the lower end of the catalyst 46 and the exhaust guide 6 and between the upper end of the catalyst 46 and the housing 45. Also, the cushioning member 54 may be disposed just between the upper end of the catalyst 46 and the housing 45. Further as shown in FIG. 15, the catalyst 46 may be sandwiched directly by the housing 45 and the exhaust guide 6 without the cushioning member 54 being provided.

Also, with each of the above-described preferred embodiments, a case where the cylinder body 3 is supported from below by the exhaust guide 6 via the gasket 53 was described (see, for example, FIG. 9). However, the cylinder body 3 may instead be supported directly by the exhaust guide 6 as shown in FIG. 14 and FIG. 15.

Also, with each of the above-described preferred embodiments, a case where the drain passage 75 is connected to the lowermost end of the upstream side exhaust duct 31 was described. However, the drain passage 75 may be connected to a portion besides the lowermost portion of the upstream side exhaust duct 31. Or, the drain passage 75 may be connected to the downstream side exhaust duct 52. That is, it suffices that the drain passage 75 be connected, at the upstream side of the catalyst 46, to at least one of the upstream side exhaust duct 31 and the downstream side exhaust duct 52.

The present application corresponds to Japanese Patent Application Nos. 2009-067646 and 2010-047962 respectively filed on Mar. 19, 2009 and Mar. 4, 2010 in the Japan Patent Office, and the entire disclosures of these applications are incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine including a cylinder, and a crankshaft disposed along a vertical direction;

an exhaust guide arranged to support the engine from below; and a catalyst disposed in an interior of the engine; wherein the engine includes a cylinder body including a housing portion unitary with the cylinder body and arranged to house the catalyst;

the cylinder body includes a first exhaust passage that includes an interior of the housing portion;

the housing portion includes, at a lower end portion of the cylinder body, an opening that is not smaller than an outer shape of the catalyst such that the catalyst fits through the opening when inserted from below;

the catalyst is sandwiched from above and below by the housing portion and the exhaust guide, respectively, when the catalyst is inserted into the housing portion; and the catalyst is disposed at a side of the cylinder, and the cylinder body includes a first cooling water passage disposed in a periphery of the cylinder and a second cooling water passage disposed in a periphery of the catalyst, the second cooling water passage is connected to the first cooling water passage at a location between the cylinder and the catalyst.

2. The outboard motor according to claim 1, further comprising an intermediate member disposed at least at one of a location between the catalyst and the housing portion and a location between the catalyst and the exhaust guide, wherein the catalyst is sandwiched from above and below by the housing portion and the exhaust guide via the intermediate member.

3. The outboard motor according to claim 2, wherein the intermediate member includes an elastic member.

4. An outboard motor comprising:

an engine including a cylinder, and a crankshaft disposed along a vertical direction;

an exhaust guide arranged to support the engine from below; and a catalyst disposed in an interior of the engine; wherein the engine includes a cylinder body including a housing portion arranged to house the catalyst;

the cylinder body includes a first exhaust passage that includes an interior of the housing portion; and the catalyst is inserted into the housing portion from below, and is sandwiched from above and below by the housing portion and the exhaust guide; wherein the engine includes a cylinder head coupled to the cylinder body, the cylinder head includes a second exhaust passage arranged to connect the cylinder and the first exhaust passage;

the cylinder body includes a first mating surface, and a first end surface disposed on a same plane as the first mating surface;

the cylinder head includes a second mating surface in contact with the first mating surface, and a second end surface disposed on a same plane as the second mating surface;

the first exhaust passage includes an exhaust entrance arranged to open at the first end surface; and the second exhaust passage includes an exhaust exit arranged to open at the second end surface, the exhaust exit connected to the exhaust entrance.

5. The outboard motor according to claim 1, wherein the cylinder body includes a supported surface, supported by the exhaust guide, provided at the lower end portion of the cylinder body, the housing portion includes a lower surface disposed on a same surface as the supported surface, and the opening of the housing portion opens at the lower surface.

6. The outboard motor according to claim 1, wherein the outer shape of the catalyst as viewed from a direction in which the exhaust passes through the catalyst is circular.

7. The outboard motor according to claim 1, wherein the engine includes a cylinder head coupled to the cylinder body, the cylinder head including a second exhaust passage arranged to connect the cylinder and the first exhaust passage;

the catalyst is disposed such that an upper end of the catalyst is positioned above a lower end of the cylinder; and the outboard motor includes a drain passage connected to at least one of the first exhaust passage and the second exhaust passage at an upstream side of the catalyst.

8. An outboard motor comprising:

an engine including a cylinder, and a crankshaft disposed along a vertical direction;

an exhaust guide arranged to support the engine from below; and a catalyst disposed in an interior of the engine; wherein the engine includes a cylinder body including a housing portion arranged to house the catalyst;

the cylinder body includes a first exhaust passage that includes an interior of the housing portion;

the catalyst is inserted into the housing portion from below, and is sandwiched from above and below by the housing portion and the exhaust guide;

the engine includes a cylinder head coupled to the cylinder body, the cylinder head including a second exhaust passage arranged to connect the cylinder and the first exhaust passage;

the catalyst is disposed such that an upper end of the catalyst is positioned above a lower end of the cylinder;

the outboard motor includes a drain passage connected to at least one of the first exhaust passage and the second exhaust passage at an upstream side of the catalyst; and the drain passage includes a first end portion connected to at least one of the first exhaust passage and the second exhaust passage at the upstream side of the catalyst, and a second end portion connected to the first exhaust passage at a downstream side of the catalyst.

9. An outboard motor comprising:

an engine including a cylinder, and a crankshaft disposed along a vertical direction;

an exhaust guide arranged to support the engine from below; and a catalyst disposed in an interior of the engine; wherein the engine includes a cylinder body including a housing portion arranged to house the catalyst;

the cylinder body includes a first exhaust passage that includes an interior of the housing portion;

the catalyst is inserted into the housing portion from below, and is sandwiched from above and below by the housing portion and the exhaust guide;

the engine includes a cylinder head coupled to the cylinder body, the cylinder head including a second exhaust passage arranged to connect the cylinder and the first exhaust passage;

the catalyst is disposed such that an upper end of the catalyst is positioned above a lower end of the cylinder;

the outboard motor includes a drain passage connected to at least one of the first exhaust passage and the second exhaust passage at an upstream side of the catalyst;

the second exhaust passage includes an exhaust exit connected to the first exhaust passage;

the exhaust exit is disposed above a lowermost end of the second exhaust passage at a downstream side relative to the lowermost end of the second exhaust passage; and the drain passage is connected to the lowermost end of the second exhaust passage, and is arranged such that water is discharged from the lowermost end of the second exhaust passage to the drain passage.

10. An outboard motor comprising:

an engine including a cylinder, and a crankshaft disposed along a vertical direction;

an exhaust guide arranged to support the engine from below; and a catalyst disposed in an interior of the engine; wherein the engine includes a cylinder body including a housing portion arranged to house the catalyst;

the cylinder body includes a first exhaust passage that includes an interior of the housing portion;

the catalyst is inserted into the housing portion from below, and is sandwiched from above and below by the housing portion and the exhaust guide;

the engine includes a cylinder head coupled to the cylinder body, the cylinder head including a second exhaust passage arranged to connect the cylinder and the first exhaust passage;

the catalyst is disposed such that an upper end of the catalyst is positioned above a lower end of the cylinder;

the outboard motor includes a drain passage connected to at least one of the first exhaust passage and the second exhaust passage at an upstream side of the catalyst; and the engine includes a valve connected to the drain passage, the valve arranged to control a flow of a fluid in the drain passage.

11. The outboard motor according to claim 10, wherein the valve includes a float arranged to open and close the valve according to a water amount in the valve.

* * * * *